US011304585B2

(12) United States Patent
Beal

(10) Patent No.: US 11,304,585 B2
(45) Date of Patent: Apr. 19, 2022

(54) CLEANING DEVICE WITH FLEXIBLE HEAD AND UNIVERSAL HANDLE ADAPTER

(71) Applicant: Brandon Michael Beal, Cincinnati, OH (US)

(72) Inventor: Brandon Michael Beal, Cincinnati, OH (US)

( * ) Notice: Subject to any disclaimer, the term of this patent is extended or adjusted under 35 U.S.C. 154(b) by 21 days.

(21) Appl. No.: 17/106,035

(22) Filed: Nov. 27, 2020

(65) Prior Publication Data

US 2021/0290029 A1 Sep. 23, 2021

Related U.S. Application Data

(60) Provisional application No. 62/907,278, filed on Sep. 27, 2019.

(51) Int. Cl.

| | |
|---|---|
| ***A47L 13/44*** | (2006.01) |
| ***A47L 13/16*** | (2006.01) |
| ***H01K 3/32*** | (2006.01) |
| ***A47L 25/12*** | (2006.01) |
| ***A47L 25/00*** | (2006.01) |

(52) U.S. Cl.

CPC ..... *A47L 13/44* (2013.01); *A47L 13/16* (2013.01); *A47L 25/12* (2013.01); *H01K 3/32* (2013.01); *A47L 25/00* (2013.01)

(58) Field of Classification Search

CPC ..... A47L 13/16; A47L 13/44; A47L 13/46; A47L 13/50; A47L 13/10; A47L 13/24; A47L 13/25; A47L 13/29; A47L 13/42; A47L 25/00; A47L 25/04; A47L 25/12; B25G 1/04; H01K 3/32; A47K 11/10

USPC .... 15/231, 247, 209.1–210.1; 81/53.1–53.12

See application file for complete search history.

(56) References Cited

U.S. PATENT DOCUMENTS

| | | | | |
|---|---|---|---|---|
| 750,408 A * | 1/1904 | Speelman | ..... | H01K 3/32 81/53.12 |
| 2,526,084 A * | 10/1950 | Penn | ..... | H01K 3/32 81/53.11 |
| 9,236,239 B1 * | 1/2016 | Kalymon | ..... | H01K 3/32 |

* cited by examiner

*Primary Examiner* — Laura C Guidotti
*Assistant Examiner* — Jacob Adam Montgomery

(57) ABSTRACT

A method and system for cleaning complex, elevated fixtures and appliances having compound curves, such as but not limited to security camera lenses and light bulbs. The invention having two main parts. A first part comprised of a conventional, telescoping rod and a second part being a flexible adapter head configured to receive and secure a cleaning towel therein. Said flexible adapter head allows a user to access and clean difficult-to-reach fixtures positioned at various angles. The adapter head also containing a flexible hoop allowing the affixed towel to remain in contact with the feature being cleaned. Other embodiments may include a flexible adaptor head with collar that fits on a plurality of handles and rods such as broom handles and PVC pipes etc. according to a user's preference. An object of the invention is to provide a more accurate means to reach and clean elevated fixtures more efficiently.

17 Claims, 6 Drawing Sheets

CLEANING DEVICE WITH FLEXIBLE HEAD AND UNIVERSAL HANDLE ADAPTER

CROSS-REFERENCE TO RELATED APPLICATION

This application claims the benefit of U.S. Provisional Application No. 62/907,278, filed Sep. 27, 2019.

FIELD OF THE INVENTION

The present invention generally relates to cleaning accessories. More specifically, it relates to a cleaning system having a conventional, telescoping rod and a second part being a flexible adapter head.

BACKGROUND

The first mops appeared in England in the late 1400s and were made from old pieces of cloth and so-called "mop nails"—long nails with a wide flat head which would hold the pieces and then nailed into a handle. Centuries later an American inventor named Jacob Howe patented a mop holder in 1837 and Thomas Stewart patented his variant of a mop (a deck mop made of yarn) in 1893. Peter Vosbikian patented a sponge mop in 1950. In 1999, Scotch Brite developed a wet mop which is made of natural cellulose and did not leave lint like a cloth mop. Dry-mops are made of yarn or microfiber textiles and are used to pick up dust, sand or other dry dirt. When the floors are cleaned professionally, it is used as a first step in cleaning. When dirty, the mop can be washed in a washing machine—if it is of a single-use kind it is thrown away. Wet-mops or moist-mops are used in a second step of the professional cleaning. Their heads are made of flat sheets of microfiber cloth or of sheets with a surface of looped yarn. They can clean fat, mud and dried-in liquids of the floor. Mops for pre-moisturizing are flat mops of microfiber cloth that are moistened before they are used and don't need buckets of water because they hold enough water and detergent to "work." They are connected to a handle with a Velcro so they can be detached and attached with ease. They also don't leave puddles from the excess of water if they are ideally wetted according to recommendations of the manufacturer.

Looped end mops are made of looped yarn (they have loop at the free end compared to cut end mops). They provide more surface are, can contain more water, and can last longer. If they are made of cotton, or mixture of polyester and cotton they are also not machine washable. Microfiber mops have heads that are made from polyester and polyamide. They hold to dirt that they cleaned until washed in water and can hold larger quantities of water than any other type of mop. The cleaning industry has begun developing mops with specialized adapter heads. U.S. Pat. Nos. 2,469,060A and 3,287,756A granted to Peter Vosbikian and Thomas Vosbikian and Frank Gesell respectively teach of a mop having a flexible adapter head; however they are rectangular in shape and do not allow for easy rotational cleaning. U.S. Pat. No. 2,164,398A John Glover disclosed a flexible, circular mop head adapter; however, it does not incorporate a telescoping handle.

SUMMARY OF THE INVENTION

The device herein disclosed and described provides a solution to the shortcomings in the prior art through the disclosure of an extendable cleaning device with flexible adaptor head. An object of the invention is to allow a user to reach fixtures at high elevations. The telescoping rod has interlocking components allowing a user to reach a plurality of heights.

BRIEF DESCRIPTION OF THE FIGURES

The accompanying drawings, which are incorporated herein and form a part of the specification, illustrate some, but not the only or exclusive, examples of embodiments and/or features.

Other aspects of the present invention shall be more readily understood when considered in conjunction with the accompanying drawings, and the following detailed description, neither of which should be considered limiting.

DETAILED DESCRIPTION OF THE INVENTION

In this description, the drawings and are used for convenience only; they are not intended to be limiting or to imply that the device has to be used or positioned in any particular orientation. Conventional components of the invention are elements that are well-known in the prior art and will not be discussed in detail for this disclosure.

Figure 1:
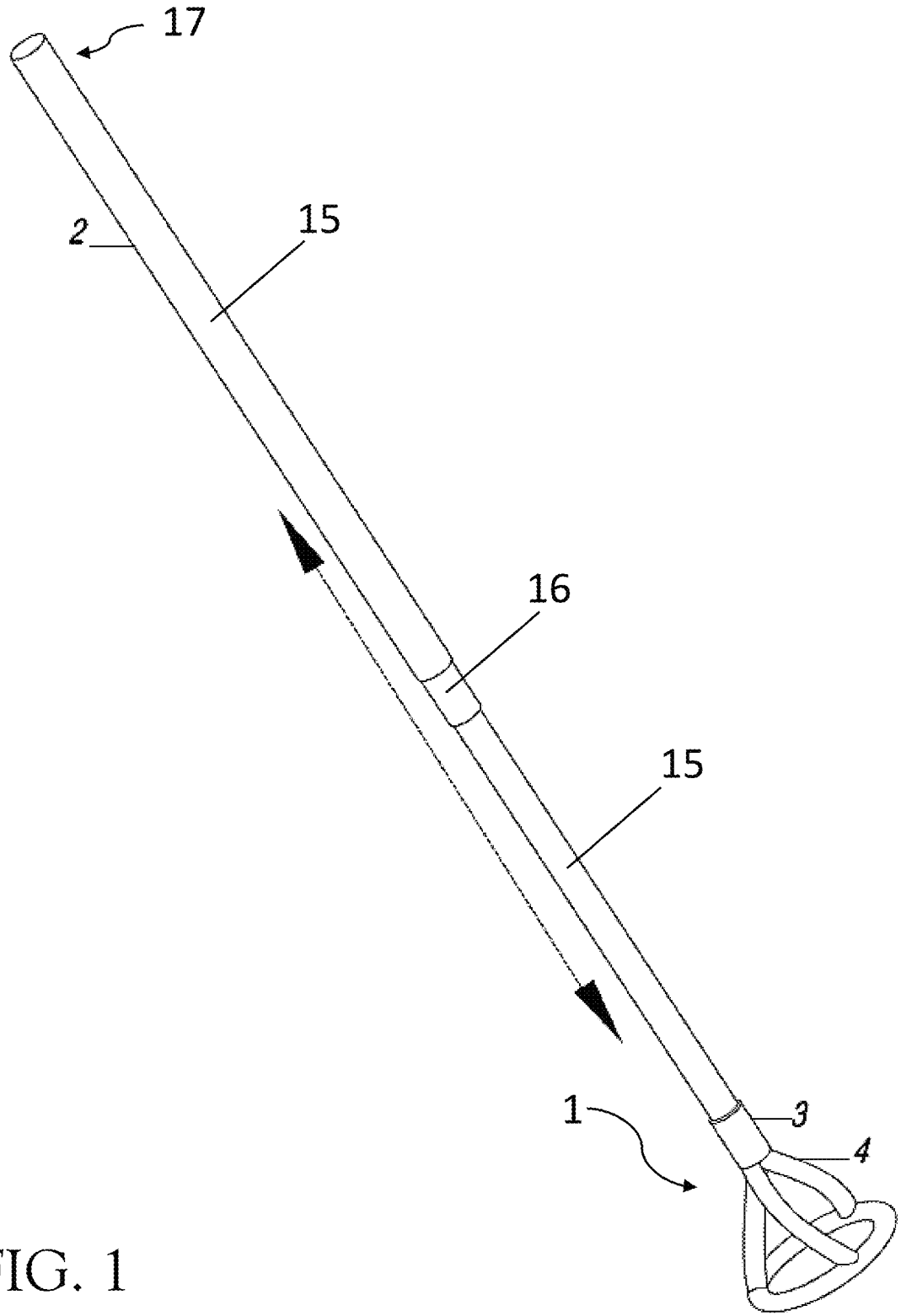
FIG. 1 shows a perspective view of the invention including the adapter head and the rod.

The invention comprises a flexible adapter head 1 which, as shown in FIG. 1, would typically be attached to a rod 2 and used for cleaning devices which may be difficult to reach or have complex shapes. In the preferred embodiment, the rod 2 is fixedly connected to the adapter head 1 by means of a collar 3.

The rod 2 may comprise any number of configurations and users may customize handles or rods at different heights depending on their application needs and affix them to said collar 3. In the preferred embodiment, the rod comprises a conventional telescopic rod 2 being telescopic and comprised of a plurality of handle cylinders 15 having progressively smaller diameters allowing them to fit within one another along with a twist lock 16 on each section that allows the device to expand or contract according to a user's preference. The handle cylinders being made of a rigid, lightweight material such as but not limited to aluminum, plastic and the like. In alternative embodiments the rod 2 may comprise single piece structures such as wooden poles, PVC pipes, or other elongated members. At the proximal end of the rod 17, handles or grips may exist which may either be formed into the rod 2 or applied, such as a silicon boot with a preformed grip that slides onto the end of the rod 2.

Figure 2:
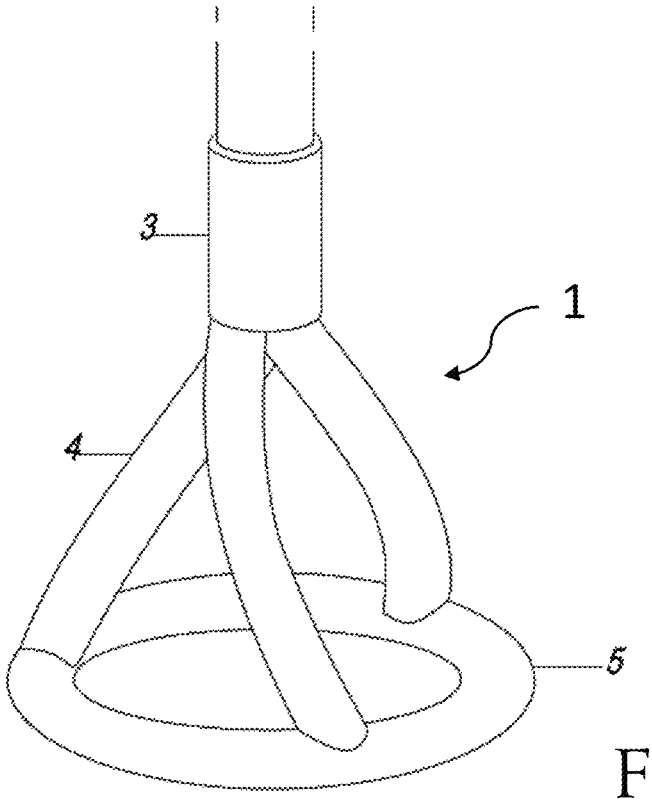
FIG. 2 shows a perspective view of the adapter head.

The flexible adapter head 1 is positioned at the distal end of the rod. In the preferred embodiment as shown in FIG. 2, the adapter head 1 generally comprises a collar 3 which attaches to the rod, a plurality of flexible spokes 4 which extend from the collar to a central ring 5. In the preferred embodiment, the adapter head 1 is formed from a homogeneous piece of a flexible material such as but not limited to rubber, silicone and the like. In alternative embodiments, different materials may be used to manufacture the adapter head 1 to accommodate the functionality disclosed herein.

In the preferred embodiment, the collar 3 is generally a tube-like structure which receives the rod 2. The receiving length of the collar 3 in the preferred embodiment may be approximately 2 to 4 inches although greater or shorter lengths may exist. There are numerous ways to connect the collar 3 onto the rod 2. The wall thickness of the collar 3 is dependent upon the method chosen for attaching the rod 2 to the adapter head 1.

Figure 4:
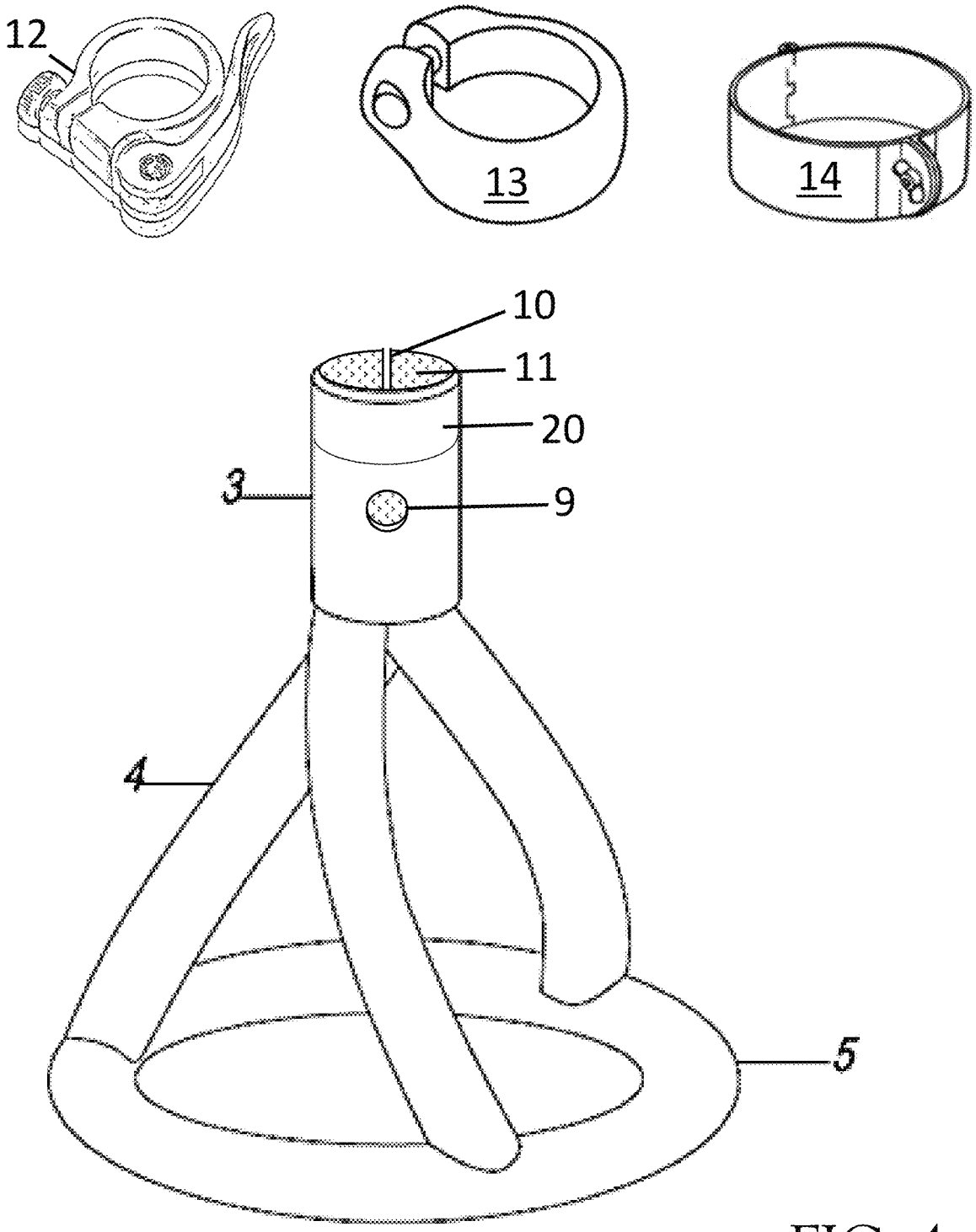
FIG. 4. Shows methods of clamping the adapter head to a rod.

As shown in FIG. 4, the collar 3 has an interior surface 11. In some embodiments, the interior surface 11 may be a threaded such as to receive a screw like mechanism at the distal end of the rod 2. In some embodiments, the collar 3 may be secured to the distal end of the rod 2 by a fastener such as a screw, rivet, or nail, which may pass through a fastener hole 9 in the collar. In some embodiments, the collar 3 may be secured on to the distal end of the rod 2 by a clamp-like fastener, which is placed over the collar 3 and radially compresses the collar 3 onto the rod 2 to create a frictional hold. In one embodiment, the clamp is positioned at the proximal end of the adapter head 1. Examples of a clamp-like fastener are shown in FIG. 4 and may include a cam latch fastener 12, a compression fastener 13, or a threaded clamp fastener 14. To aid the clamp-like fixture, the collar 3 may include a vertical slit 10 or a plurality of slits 10 near the clamp area 20 of the collar such that the radially compression forces created by the clamp-like fixture do not deform the overall radius of the collar 3. In the preferred embodiment, the collar 3 is formed from a uniform material as the adapter head 1, however, in another embodiment, the collar 3 may be formed independently of the adapter head 1.

Figure 3:
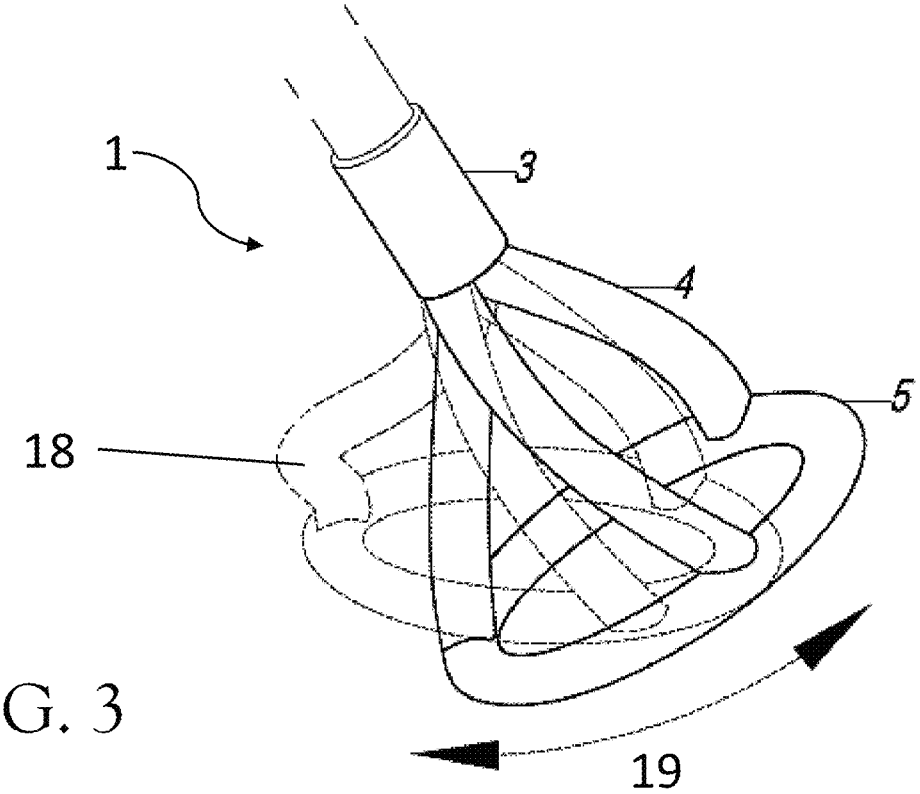
FIG. 3 illustrates the flexibility of the adapter head.

As stated, the flexible spokes 4 connect between the collar 3 and the central ring 5. The boundary formed by the central ring 5 creates the area which will be the cleaning surface when a scrubbing cloth 8 is applied. FIG. 3 illustrates a fundamental inventive concept of the adapter head 1 which is its ability for the twisted spokes 4 to flex and conform under pressure such that the central ring 5 is able to articulate to various angles 19 against a cleaning surface. In the preferred embodiment, there are three twisted spokes 4 shown, but the inventive concept exists is functional where a plurality of twisted spokes 4 are present. In the preferred embodiment, the distal end of the flexible spokes 4 are equally spaced across the circumference of the central ring 5, however, in certain applications it may be beneficial to have a larger gap in one section of the circumference of the central ring 5. In some embodiments, the central ring 5 has a greater cross-sectional bending stiffness or flexural rigidity than the twisted spokes 4. In some embodiments, the central ring 5 has a similar or equal cross-sectional bending stiffness or flexural rigidity than the twisted spokes 4.

The twisted spokes 4 are generally non-liner members which extend radially from the smaller circumference of the collar 3 to the larger circumference of the central ring 5. In the preferred embodiment, a twisted spoke 4 follows a path defined as an arc segment of a helico-spiral extending from the collar 3 to the central ring 5. The non-linear nature of the twisted spokes 4 aid in allowing the twisted spokes 4 to bend or collapse, as shown as element 18, in response to pressure applied by the user 7 through the rod 2 and the cleaning surface in communication with the central ring 5. In the preferred embodiment, the twisted spokes 4 are formed from a uniform material as the adapter head 1, however, in another embodiment, the twisted spokes 4 may be formed independently of the adapter head 1. In one embodiment, the twisted spokes 4 may be formed as hollow tubes, solid tubes, or u-shaped channels. In the preferred embodiment, the twisted spokes 4 are non-linear, however, in some embodiments such as the u-shaped channel, the twisted spokes 4 may be more linear in nature.

Figure 5:
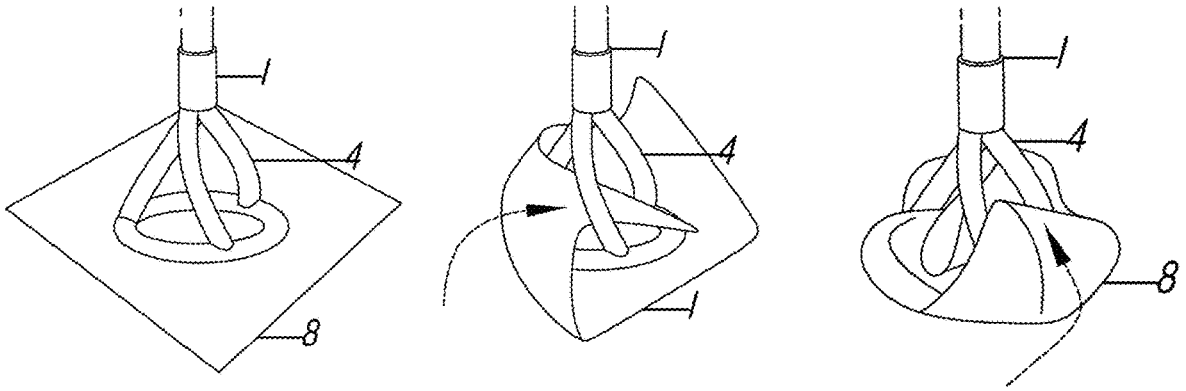
FIG. 5 shows the adapter head being fitted with a scrubbing cloth.
Figure 6:
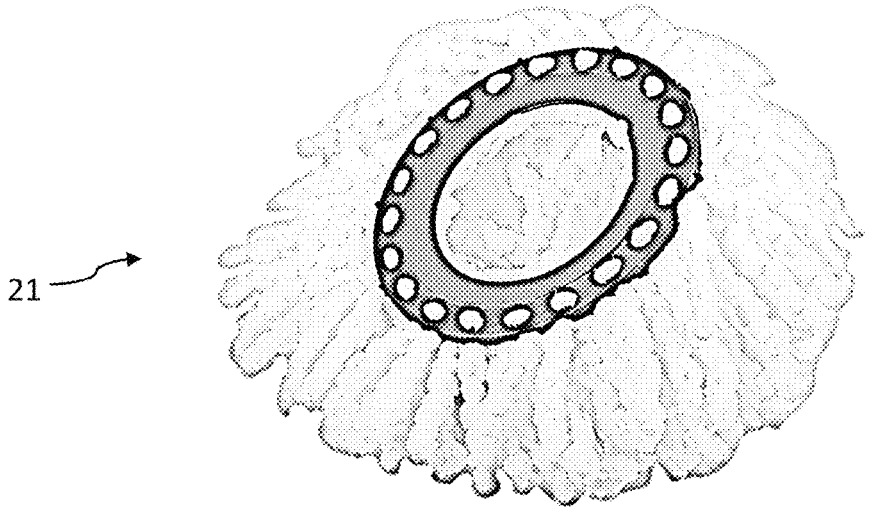
FIG. 6 shows an alternative mop head for the adapter head.

FIG. 5 illustrates the installation of a scrubbing cloth 8 being affixed to adapter head 1 with corners of said scrubbing cloth 8 being selectively threaded between the adapter head spokes. While microfiber has significant advantages as those stated in this disclosure, other cleaning elements like the mop head attachment 21 shown in FIG. 6 may work best for some applications.

Figure 7:
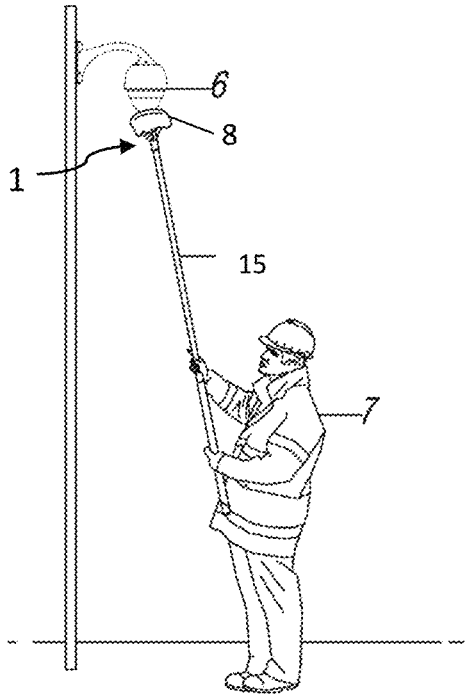
FIG. 7 shows the invention being used on an elevated security camera.
Figure 8:
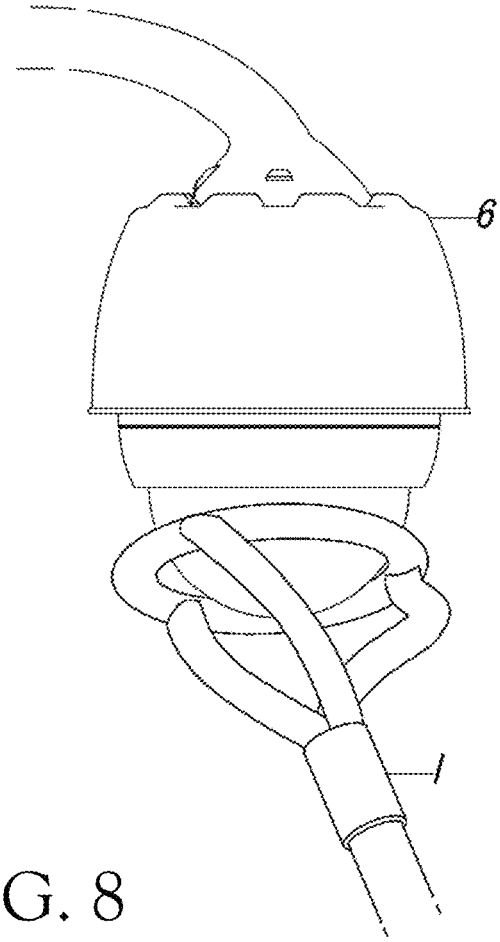
FIG. 8 shows the adapter had conforming to the security camera lens.

FIG. 7 showing user 7 cleaning an elevated security camera 6. FIG. 8 illustrating the adapter head in a flexed position and conforming to said security camera 6's protective lens allowing for more efficient cleaning.

Another object of the invention is to provide a means to allow a user to affix a multitude of cleaning mediums such as towels and shammies etc. The adapter head has multiple attachment points that allow a user to affix a multitude of textiles.

Another object of this invention is to accommodate for multiple angles when cleaning a fixture. The adapter head is flexible allowing for the user to apply pressure and clean the entire surface of a fixture even when the telescoping rod is held at an acute angle or perpendicular to a fixture.

Another object of this invention is to allow a user to select from a myriad of handles when using the invention. The flexible adaptor head has several embodiments that include a threaded attachment (that can fit on broom handles etc.) as well as attachments of varying diameters to fit on a wide array of custom handles or poles depending on the user's preference.

To summarize the invention, the invention would comprise of a head adapter head adapter for cleaning configured to attach to a distal end of a pole and to enable attachment of a cleaning cloth. The head adapter comprising, as shown in FIG. 2, includes a collar 3 for receiving the distal end pole, a plurality of spokes 4 connecting between collar and an central ring 5. It should be noted that the collar, plurality of spokes, and central ring share a common central axis extending from the collar to the center of the ring. The central ring is generally toroidal shaped, flexible, and attached at the distal end of the spokes, configured to attach the cleaning cloth, and the central ring has a diameter between 2.5 to 10 inches.

Furthermore, the collar includes an interface to connect the distal end of the pole. The pole may be telescopic in nature.

Figure 9:
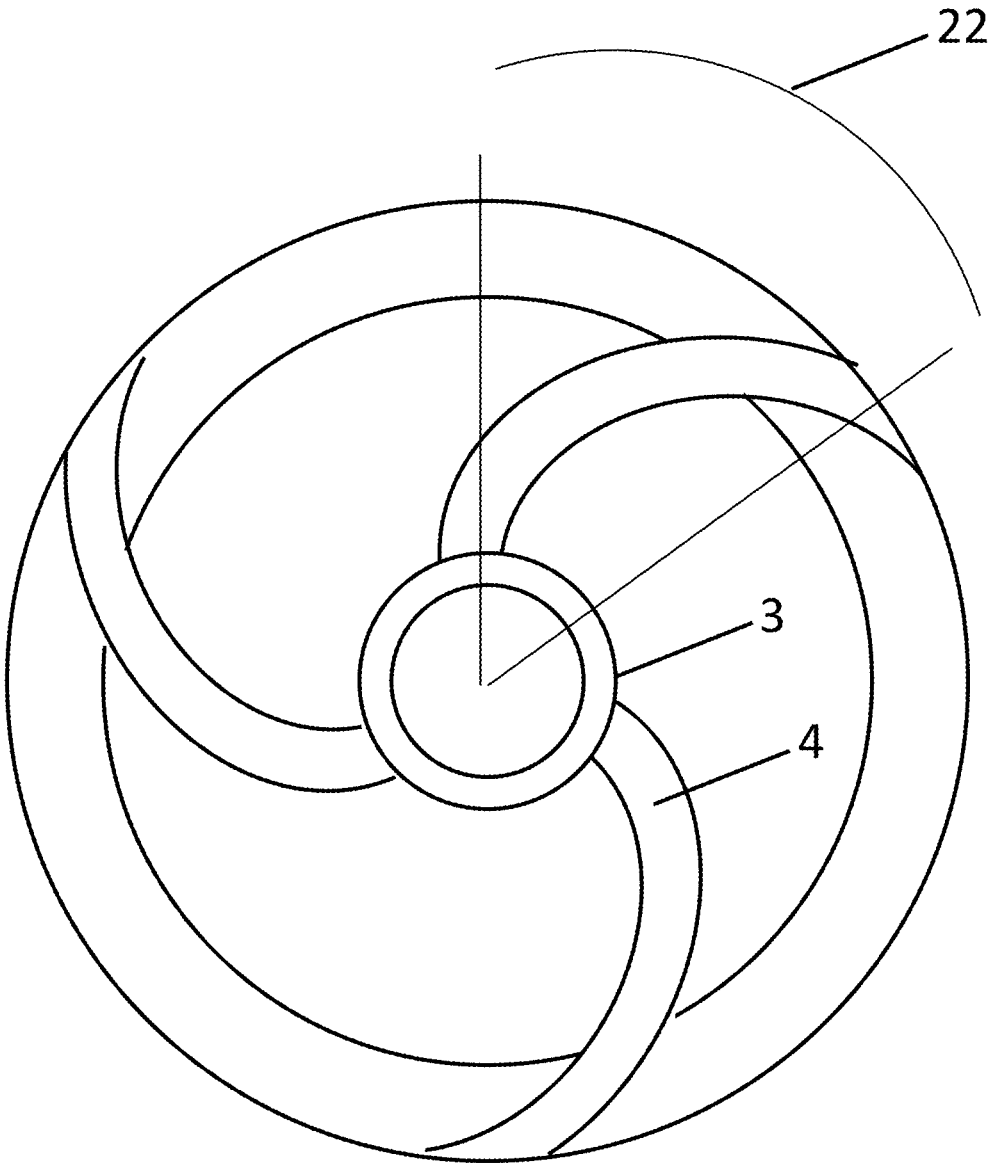
FIG. 9 shows a top view of the adapter head.

The plurality of spokes originates and extends from a point at the distal end of the collar, and each spoke within the plurality of spokes are generally of equal length, are flexible and have a durometer, and extend outward following a helical-spiral path from the point at the distal end of the collar and terminating at a point on the central ring. The spiral component of the helical-spiral path is defined by an angle of rotation 22 as shown in FIG. 9, and wherein the angle of rotation is identical for each spoke included in the plurality of spokes and the angle of rotation is between 20 and 70 degrees and preferably 30 to 45 degrees. It should be noted that their may be variations in the number of spokes which may range from 2 to 8 spokes, but preferably 3 spokes as shown.

For manufacturing, it is desirable for the complete head adapter, the collar, the plurality of spokes, and the central ring to be constructed as a single body.

In interface between the collar and the pole may comprise a cupped interface having an opening configured to receive the distal end of the pole. The pole may be held into the collar by a clamping device causing the collar to constrict around the distal end of the pole for securing the pole within the cupped opening. Alternatively, the pole may be secured into the collar by a threaded interface configured to mate with a threaded interface on the distal end of the pole. This collar interface may be male or female, or to say it alternatively, the interface to connect the distal end of the pole includes a thread on an exterior surface of the collar (e.g. male) or the interface to connect the distal end of the pole includes a thread on an interior surface of the collar (e.g. female).

The central ring is placed on top of the cleaning cloth and wrapped as shown in FIG. 5. The cleaning cloth has a surface defined by a surface area, and the diameter of the central ring can be fully inscribed inside the surface are of the cleaning cloth. The cleaning cloth is generally rectangular with corners extending beyond a circumference characterize by the central ring in communication the surface of the cleaning cloth.

The corners of the cleaning cloth are wrapped around central ring. In the primary embodiment, the corners of the cleaning cloth fold around the exterior of the central ring and pass between the spokes. A corner of the corners of the cleaning cloth may engage the back surface of the cleaning cloth for the purpose of creating a frictional bond which holds the cleaning cloth in position.

Alternatively, the cleaning cloth may be customized to fit around the central ring and use elastic to hold it in place. Specifically, the cleaning cloth may include an elastic band around the perimeter of the cleaning cloth which operates between a stretched and a secured state, wherein the stretched state allows the perimeter formed by the elastic band to extend beyond an outer circumference characterized by the central ring, and wherein the secured state is defined by the elastic band constricted to create a perimeter smaller than the outer circumference of the central ring.

It is additionally noted and anticipated that although the device is shown in its simplest form, various components and aspects of the device may be differently shaped or slightly modified when forming the invention herein. As such those skilled in the art will appreciate the descriptions and depictions set forth in this disclosure or merely meant to portray examples of preferred modes within the overall scope and intent of the invention, and are not to be considered limiting in any manner. While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth.

It is briefly noted that upon a reading this disclosure, those skilled in the art will recognize various means for carrying out these intended features of the invention. As such it is to be understood that other methods, applications and systems adapted to the task may be configured to carry out these features and are therefore considered to be within the scope and intent of the present invention, and are anticipated. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention. As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

The objects, features, and advantages of the present invention, as well as the advantages thereof over existing prior art, which will become apparent from the description to follow, are accomplished by the improvements described in this specification and hereinafter described in the following detailed description which fully discloses the invention, but should not be considered as placing limitations thereon.

What is claimed is:

1. A head adapter for cleaning configured to attach to a distal end of a pole and to enable attachment of a cleaning cloth, said head adapter comprising: a collar for receiving the distal end pole, a plurality of spokes connecting between collar and a central ring;

wherein the collar, plurality of spokes, and central ring share a common central axis;

wherein the collar includes an interface to connect the distal end of the pole;

wherein the plurality of spokes originates and extends from a point at the distal end of the collar;

wherein each spoke within the plurality of spokes are generally of equal length, are flexible and have a durometer, and extend outward following a helical-spiral path from the point at the distal end of the collar and terminating at a point on the central ring; and wherein the central ring is generally toroidal shaped, flexible, and attached at the distal end of the spokes and attached to the cleaning cloth.

2. The head adapter of claim 1 wherein, a spiral component of the helical-spiral path is defined by an angle of rotation, and wherein the angle of rotation is identical for each spoke included in the plurality of spokes.

3. The head adapter of claim 2 wherein, the angle of rotation is between 20 and 70 degrees.

4. The head adapter of claim 2 wherein, the plurality of spokes comprises between 2 and 8 spokes.

5. The head adapter of claim 2 wherein, the plurality of spokes comprises exactly three spokes.

6. The head adapter of claim 1 wherein, the collar, the plurality of spokes, and the central ring are constructed as a single body.

7. The head adapter of claim 1 wherein, the interface to connect the distal end of the pole includes a cupped interface having an opening configured to receive the distal end of the pole.

8. The head adapter of claim 7 wherein, the collar further includes a clamping device causing the collar to constrict around the distal end of the pole for securing the pole within the cupped opening.

9. The head adapter of claim 7 wherein, the cupped interface of the collar includes a threaded interface configured to mate with a threaded interface on the distal end of the pole.

10. The head adapter of claim 1 wherein, the interface to connect the distal end of the pole includes a thread on an exterior surface of the collar.

11. The head adapter of claim 1 wherein, the central ring has a diameter between 2.5 to 10 inches.

12. The head adapter of claim 1 wherein, the cleaning cloth has a surface defined by a surface area, and the diameter of the central ring can be fully inscribed inside the surface are a of the cleaning cloth.

13. The head adapter of claim 12 wherein, the head adapter further comprises the cleaning cloth and wherein the cleaning cloth is generally rectangular with corners extending beyond a circumference characterize by the central ring in communication the surface of the cleaning cloth.

14. The head adapter of claim 13 wherein, the corners of the cleaning cloth are wrapped around central ring.

15. The head adapter of claim 12 wherein, the cleaning cloth includes an elastic band around the perimeter of the cleaning cloth which operates between a stretched and a secured state, wherein the stretched state allows the perimeter formed by the elastic band to extend beyond an outer circumference characterized by the central ring, and wherein the secured state is defined by the elastic band constricted to create a perimeter smaller than the outer circumference of the central ring.

16. The head adapter of claim 14 wherein, the corners of the cleaning cloth fold around the exterior of the central ring and pass between the spokes.

17. The head adapter of claim 16 wherein, a first corner of the corners of the cleaning cloth engages the surface of the cleaning cloth for the purpose of creating a frictional bond which holds the cleaning cloth in position.

* * * * *